US011155085B2

(12) United States Patent
Wang et al.

(10) Patent No.: US 11,155,085 B2
(45) Date of Patent: Oct. 26, 2021

(54) THERMAL FLUID EJECTION HEATING ELEMENT

(71) Applicant: HEWLETT-PACKARD DEVELOPMENT COMPANY, L.P., Spring, TX (US)

(72) Inventors: Stanley J Wang, Corvallis, OR (US); Erik D Torniainen, Corvallis, OR (US); Vincent C Korthuis, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/619,156

(22) PCT Filed: Jul. 17, 2017

(86) PCT No.: PCT/US2017/042398

§ 371 (c)(1),
(2) Date: Dec. 4, 2019

(87) PCT Pub. No.: WO2019/017880

PCT Pub. Date: Jan. 24, 2019

(65) Prior Publication Data

US 2020/0139707 A1 May 7, 2020

(51) Int. Cl.
*B41J 2/14* (2006.01)
*H05B 3/14* (2006.01)

(52) U.S. Cl.
CPC ..... *B41J 2/1412* (2013.01); *H05B 3/141* (2013.01); *B41J 2/14129* (2013.01); *H05B 2203/011* (2013.01); *H05B 2203/013* (2013.01); *H05B 2203/021* (2013.01)

(58) Field of Classification Search
CPC ..... B41J 2/1412
See application file for complete search history.

(56) References Cited

U.S. PATENT DOCUMENTS 4,318,220 A * 3/1982 Diaz ..... B29C 61/0625 29/610.1
4,745,419 A 5/1988 Quate et al.
4,782,347 A 11/1988 Kurematsu et al.
4,870,433 A * 9/1989 Campbell ..... B41J 2/1412 347/62
5,559,546 A 9/1996 Sato
6,366,305 B1 4/2002 Nakamura
(Continued)

FOREIGN PATENT DOCUMENTS

JP 04173340 A * 6/1992 ..... B41J 2/1412

OTHER PUBLICATIONS

Kwoh Chee Keong. Thermal Printing.School of Computer Engineering Nanyang Technological University. Computer Peripherals, 2011, < http://www.lintech.org/comp-per/16THERM.pdf >.

*Primary Examiner* — Shelby L Fidler
(74) *Attorney, Agent, or Firm* — Fabian VanCott

(57) ABSTRACT

A thermal fluid ejection heating element may include a first conductive trace, and an at least partially perforated resistive thin film material electrically coupling the first conductive trace to a second conductive trace. The perforations within the perforated resistive thin film material defines a resistance of the thermal fluid ejection heating element.

20 Claims, 10 Drawing Sheets

(56) References Cited

U.S. PATENT DOCUMENTS

| | | | | |
|---|---|---|---|---|
| 6,485,128 | B1 * | 11/2002 | Elshaik | B41J 2/1412 347/62 |
| 8,708,461 | B2 * | 4/2014 | Chung | B41J 2/14129 347/62 |
| 2002/0109755 | A1 * | 8/2002 | Meyer | B41J 2/14145 347/65 |
| 2005/0174390 | A1 | 8/2005 | Sun et al. | |
| 2007/0126800 | A1 * | 6/2007 | Shim | B41J 2/1412 347/62 |
| 2010/0039477 | A1 * | 2/2010 | Kuk | B41J 2/14129 347/62 |
| 2016/0059308 | A1 | 3/2016 | Volk | |
| 2017/0318625 | A1 * | 11/2017 | Bouchiat | H05B 1/0233 |

* cited by examiner

THERMAL FLUID EJECTION HEATING ELEMENT

BACKGROUND

A fluid ejection printing system may include a printhead, a fluid supply which supplies fluid such as ink to the printhead, and a controller to control the printhead. The printhead may eject fluid through a plurality of orifices or nozzles toward a print medium, such as a sheet of paper, in order to print the fluid onto the print medium. The orifices may be arranged in a number of arrays such that properly sequenced ejection of ink from the orifices causes characters or other images to be printed upon the print medium as the printhead and the print medium are moved relative to each other.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
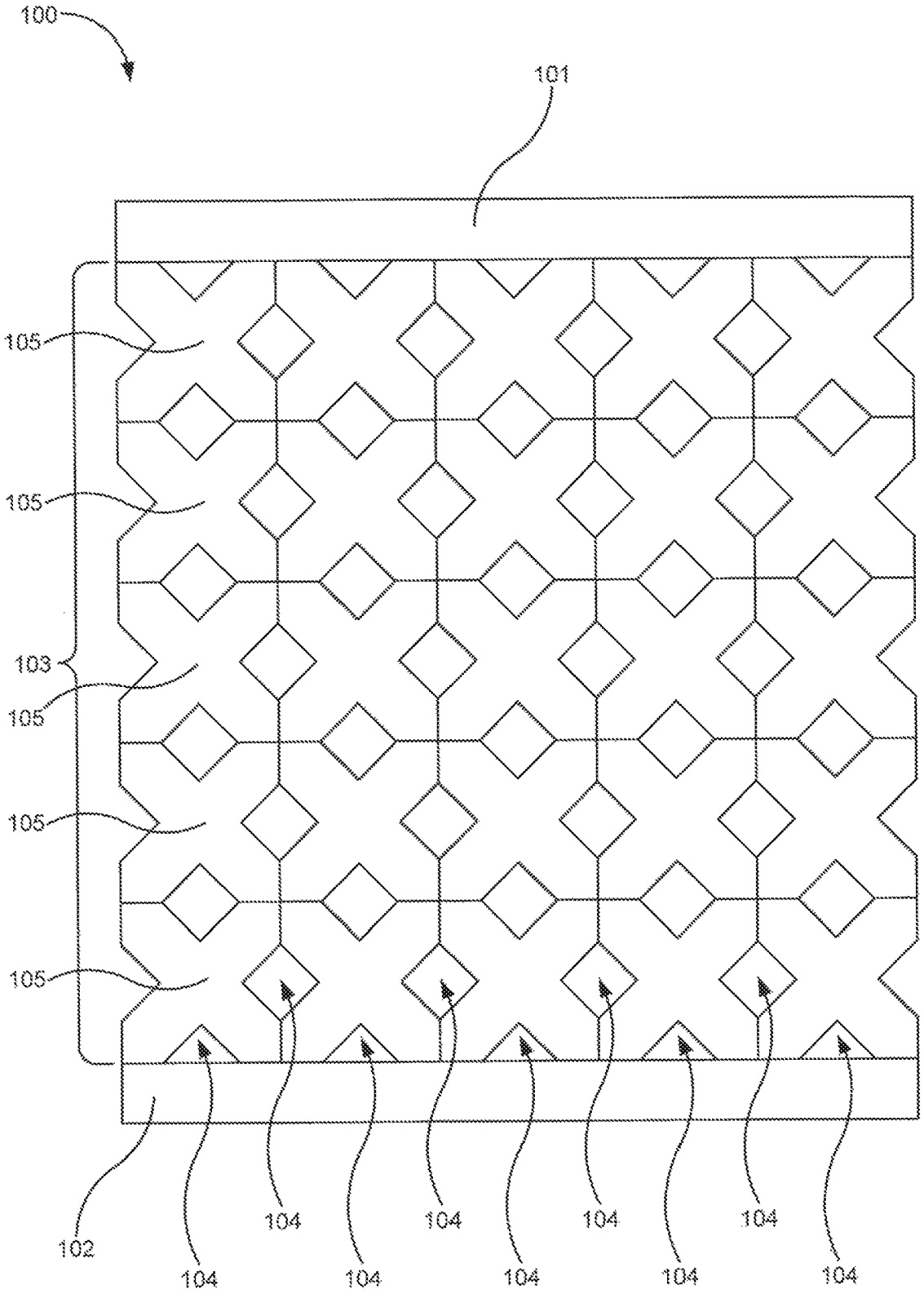
FIG. 1 is a diagram of a thermal fluid ejection heating element, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In one example, a printhead may eject the fluid through the nozzles by rapidly heating a small volume of the fluid located in vaporization chambers with small electric heating elements called thin film resistors. Heating the fluid causes the fluid to vaporize and be ejected from the nozzles. For one dot of fluid, a controller located as part of the processing electronics of a printing device, controls activation of an electrical current from a power supply external to the printhead. The electrical current is passed through a selected thin film resistor to heat the fluid in a corresponding selected vaporization chamber.

These thin film resistors may be referred to as thermal inkjet heater elements, and have been commercialized broadly with a form factor of a single, solid rectangular thin film. However, these solid rectangular thin films have a constrained resistance that is based on the thin film manufactured deposition thickness and planar geometry. Limited ranges of resistor variation are available for a geometric heater area to nozzle orifice ratio target. Another prior resistor layout design may incorporate multiple parallel resistor legs in order to reach higher effective resistance. However, this resistor form factor suffers from current crowding through the limited parallel paths.

Examples described herein provide a modified rectangular thin-film resistor that includes a number of perforations that improve the performance and efficiency while allowing the thin-film resistors to be manufactured with thicker resistor material thin-films. Thicker films are more easily manufactured to specific thickness tolerances which, in turn, improves the design performance. With a perforated thin-film resistor, a number of effective heating areas may be produced that provide larger ranges of variations not available to solid rectangular resistors while enabling the use of the more easily manufacture-able thicknesses in the thin film material.

Additionally, with the perforated, thin-film resistors, a higher nozzle pitch may be obtained due to the relatively smaller area footprint of the perforated, thin-film resistors without sacrificing an X/Y geometric ratio and resistance targets that may not otherwise be achieved. These geometric ratios and resistances enable use of specific fluid chemistries that differentiate writing systems from those that do not employ the perforated, thin-film resistors.

Furthermore, a perforated, thin-film resistor may be presented as a lattice structure. The geometries of the lattice structure including the sizes of the perforations, the locations of the perforations, the spacing between the perforations, the number of perforations, other lattice geometries, or combinations thereof may enable gradations in the resistance within the perimeter definition. These variable geometries may be used to tune the heat signature of the thin-film resistor, and adjust local current densities. In this manner, the perforated, thin-film resistors may be tuned for a specific use case. Still further, these tunable, perforated, thin-film resistors may be included within a column of thermal inkjet (TIJ) nozzles using their varying resistances to adjust parasitic influences.

A lattice form factor, perforated, thin-film resistor rectangle may enable broader practical resistances by tuning the number of perforations appropriately. The lattice form factor also enables multiple point nucleation sites along the perforated, thin-film resistors as opposed to a single central or stripe of nucleation. The lattice like approach mitigates the effect of current crowding through the limited parallel paths by providing multiple parallel current paths.

Further, nozzle circuit designs with fusible links that isolate shorted resistors from remaining circuitry within, for example, an array of TIJ thin-film resistors without system firmware intervention are attractive for high side switch (HSS) TIJ circuits since such a system would reduce the size of the TIJ thin-film resistor array.

Examples described herein provide a thermal fluid ejection heating element. The thermal fluid ejection heating element may include a first conductive trace, and an at least partially perforated resistive thin film material electrically coupling the first conductive trace to a second conductive trace. The perforations within the perforated resistive thin film material define a resistance of the thermal fluid ejection heating element. The perforated resistive thin film material may include a number of diamond-shaped perforations forming a lattice structure. In one example, the resistive thin film material may be made of tungsten silicon nitride (WSiN) or tantalum aluminum (TaAl). The temperature coefficient of resistance of the perforated resistive thin film material may be negative or positive.

A position of the perforations, a size of each of the perforations, a number of the perforations, a density of the of the perforations, an amount of non-perforated portions of the resistive thin film material, other characteristics, or combinations thereof may define a thermal signature of the thermal fluid ejection heating element. The thermal fluid ejection heating element may include at least a portion of the at least partially perforated resistive thin film material comprising at least a portion of non-perforated resistive thin film material.

Examples described herein also provide a fluid ejection device. The fluid ejection device may include a number of fluid ejection chambers, and a number of thin-film resistive elements disposed within each of the fluid ejection chambers. The resistive elements include an at least partially perforated resistive thin film material electrically coupling a first trace to a second trace. The perforations within the resistive thin film material define a resistance of the thin-film resistive elements. In one example, the perforated resistive thin film material includes a number of diamond-shaped perforations. The diamond-shaped perforations form a lattice structure in the perforated resistive thin film material. The at least partially perforated resistive thin film material may include at least a portion of non-perforated resistive thin film material. The portion of non-perforated resistive thin film material may span at least a width of a plurality of perforations of the at least partially perforated resistive thin film material. At least one of the perforations of the at least partially perforated resistive thin film material may include different dimensions, a different shape, other characteristics, or combinations thereof relative to a remainder of the perforations. Each of the thin-film resistive elements may be disposed within each of the fluid ejection chambers are perforated to ensure isolated failure with respect to other thin-film resistive elements within the fluid ejection device.

The fluid ejection device may further include a resistance gradient within at least one of the thin-film resistive elements disposed within each of the fluid ejection chambers. The resistance gradient is defined by a position of the perforations, a size of each of the perforations, a number of the perforations, a density of the perforations, an amount of non-perforated portions of the resistive thin film material, or combinations thereof. The resistance gradient defines a thermal signature of the thermal fluid ejection heating element.

Examples described herein also provide a resistor. The resistor includes a thin-film resistive material electrically coupling a first trace to a second trace, and a number of perforations defined in the thin film resistive material, the perforations defining a resistance of the resistor. The perforations define a number of resistive sub-elements in series and parallel. Further, in response to a failure of the resistor, the resistive sub-elements cascade in failure. A boundary of the resistor may be defined by a polygon. A thermal signature of the resistor may be defined by a position of the perforations, a size of each of the perforations, a number of the perforations, a density of the of the perforations, a shape of the perforations, an amount of non-perforated portions of the thin film resistive material, other characteristics, or combinations thereof.

As used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may or may not be included in other examples.

Turning now to the figures, FIG. 1 is a diagram of a thermal fluid ejection heating element (100), according to an example of the principles described herein. The thermal fluid ejection heating element (100) may include a first conductive trace (101) and a second conductive trace (102) that electrically couple a thin-film resistor (103) to, for example, control electronics of a printing device. In one example, the thin-film resistor (103) may be made of any material having a negative or positive temperature coefficient of resistance. For example, the thin-film resistor (103) may be made of tungsten silicon nitride (WSiN) or tantalum aluminum (TaAl). Further, the thin-film resistor (103) may include a number of thin-films of material layered on the resistive portion of the thin-film resistor (103). For example, an anti-cavitation film made of materials such as tantalum (Ta) may be deposited on the resistive portion of the thin-film resistor (103). In one example, the anti-cavitation film is placed on a side of the resistive portion opposite the fluid ejection side. Further, in one example, a number of dielectric films may be placed on the thin-film resistor (103) such as, for example, silicon nitride ($Si_3N_4$), silicon carbide (SiC), silicon dioxide (silica or $SiO_2$), tetraethyl orthosilicate (TEOS or $Si(OC_2H_5)_4$), or other dielectric films. In one example, the boundary of the thin-film resistor (103) may be defined by any polygon.

The thin-film resistor (103) may include a number of perforations (104) defined therein. Several of the perforations (104) are identified in FIG. 1. The perforations (104) may be formed in the thin-film resistor (103) through any number of additive and/or subtractive manufacturing methods including, for example, photolithography, etching, chemical etching, chemical deposition, wet chemistry techniques, stamping, other manufacturing methods, or combinations thereof.

The thin-film resistor (103) may be formed to include a number of characteristics that define its resistance and thermal signature. These characteristics may include, for example, a position of the perforations (104) within the thin-film resistor (103), patterns or non-patterns of the perforations (104) within the thin-film resistor (103), a size of each of the perforations (104) collectively and individually, a number of the perforations (104) defined within the thin-film resistor (103), a density of the of the perforations (104) within the thin-film resistor (103), an amount of non-perforated portions of the resistive thin film material of the thermal fluid ejection heating element (100), the existence of the perforations (104), the shape of the perforations (104), the material from which the thin-film resistor (103) is made, other characteristics, or combinations thereof. As these characteristics are described herein, the manner in which heat within the thermal fluid ejection heating element (100) is generated and dissipated may assist in describing the functionality of these characteristics. As electricity is applied to the thin-film resistor (103) of the thermal fluid ejection heating element (100), the thin-film resistor (103) balances between creating heat in the thin-film resistor (103) itself and dissipating heat to the surrounding ambient areas including, potentially, to surrounding thin-film resistors (103) in an array of thin-film resistors (103). The perimeters of each of the perforations (104) assists in dissipating heat. The perimeters of each of the perforations (104) dissipating heat reduces a larger thermal differential across the thin-film resistor (103) that may otherwise exist if the thin-film resistors (103) were, for example, a solid, rectangular-shaped thin-film resistor that didn't include the perforations (104). In this manner, the perforations (104) assist in ensuring heat in the middle of the thin-film resistor (103) may be dissipated more effectively without the heat being conducted across the bulk of, for example, a non-perforated, solid, rectangular-shaped thin-film resistor. In one example, at least one of these characteristics may be used to form a resistance gradient along the width and/or height of the thin-film resistor (103) in the examples described herein. This resistance gradient may also be used to define a resistance and thermal signature of the thin-film resistor (103).

Further, as to the characteristics of the thin-film resistor (103) described herein, these characteristics assist in improving the rate at which the thin-film resistor (103) heats up. As depicted in FIG. 1, the thin-film resistor (103) may be divided into a number of individual resistive sub-elements (105). Several of the resistive sub-elements (105) are identified in FIG. 1. Each of the resistive sub-elements (105) are either coupled to the first (101) or second (102) conductive trace, or are coupled in series and parallel to neighboring resistive sub-elements (105). Because the resistive sub-elements (105) are arranged in both series and parallel, the thin-film resistor (103) is able to heat up more quickly when a voltage is applied to the thermal fluid ejection heating element (100) because the current density through the legs of the resistive sub-elements (105) is relatively higher where a similar amount of current is run through a smaller cross-sectional piece of the thin-film resistor (103) material.

As to the first-listed characteristic of the positions of the perforations (104) within the thin-film resistor (103), in one example, the perforations (104) within the thin-film resistor (103) may be defined in various positions throughout the thin-film resistor (103). The positioning of the perforations (104) may cause higher or lower resistance levels within local areas of the thin-film resistor (103) as well as to the entirety of the thin-film resistor (103). For example, the closer two perforations (104) are to one another, the higher the current density is in the resistive material of the thin-film resistor (103) between the perforations (104). This higher current density results in higher temperatures within the thin-film resistor (103). The higher current density may also result in higher probabilities of the thin-film resistor (103) failing and becoming open circuit where the thin-film resistor (103) lacks a current path between the first conductive trace (101) and the second conductive trace (102) due to a failure of enough resistive sub-elements (105) to physically disconnect the first conductive trace (101) from the second conductive trace (102). In contrast, the further apart the two perforations (104) are to one another, the lower the current density is in the resistive material of the thin-film resistor (103) between the perforations (104).

As to a second characteristic of the thin-film resistor (103), patterns or non-patterns of the perforations (104) within the thin-film resistor (103) may be varied in order to define its resistance and thermal signature. In this example, the perforations (104) may be defined in the thin-film resistor (103) in a regular pattern such that the perforations (104) are spaced homogeneously throughout the thin-film resistor (103). However, in another example, the perforations (104) may be defined in the thin-film resistor (103) in non-uniform manner. In this example, the perforations (104) may be defined in the thin-film resistor (103) such that no pattern of perforations (104) is formed in the thin-film resistor (103), a portion less than all of the thin-film resistor (103) includes a pattern of perforations (104), or the perforations (104) are otherwise at least partially formed in the thin-film resistor (103) in a non-uniform manner.

As to a third characteristic of the thin-film resistor (103), the size of each of the perforations (104) collectively and individually may define its resistance and thermal signature. In this example, the perforations (104) may be of a non-uniform size. As to non-uniform sizes of the perforations (104), the perforations (104) may be individually larger or smaller relative to any number of other perforations (104), or collectively larger or smaller than depicted in, for example, FIG. 1. In one example, the width of the perforations (104) such as those depicted in FIG. 1 may be between 0.5 micrometers (μm) and 1.5 μm. In one example, the larger the perforations (104) are, the resistance around the perforations (104) may be larger due to current crowding, but the turn on energy (TOE, i.e., the minimum threshold energy used to produce a drive bubble within the fluid ejection chambers (201) sufficient to eject fluid from the fluid ejection chambers (201)), may be lower. The lower the TOE, the hotter the resistive sub-elements (105) and the thin-film resistor (103) get. Further, a relatively lower TOE allows the resistive sub-elements (105) and the thin-film resistor (103) to get hotter, faster such that fluid may be ejected from the fluid ejection chambers (201) faster resulting in faster print times.

Further, the perforations (104) may be positioned about the thin-film resistor (103) in a pattern, or may be formed in the thin-film resistor (103) irregularly about the thin-film resistor (103). Because the edges of each of the perforations (104) provide for a point at which the fluid may be nucleated, the pattern of the perforations (104) may be defined to provide a desired nucleation pattern. The pattern depicted in FIG. 1 includes a number of diamond-shaped perforations (104) defined in the thin-film resistor (103) in offset rows that are evenly spaced. Although, the perforations (104) may be arranged within the thin-film resistor (103) in no recognizable pattern, an ordered pattern provides for predictability in how the fluid nucleates within a firing chamber where the thermal fluid ejection heating element (100) resides.

As to a fourth characteristic of the thin-film resistor (103), the number of the perforations (104) defined within the thin-film resistor (103) may be varied to allow of more or less resistance within the thin-film resistor (103) and define the thermal signature. For example, inclusion of more perforations (104) defined within the thin-film resistor (103) may result in higher current densities between the perforations (104) and an increased number of nucleation sites along the thin-film resistor (103). In contrast, inclusion of fewer perforations (104) defined within the thin-film resistor (103) may result in lower current densities between the perforations (104) and a decrease in the number of nucleation sites along the thin-film resistor (103). Thus, the thin-film resistor (103) may be designed to include more or less perforations (104) to tune the thin-film resistor (103) to have a desired resistance and thermal signature.

As to a fifth characteristic of the thin-film resistor (103), the density of the perforations (104) within the thin-film resistor (103) may be varied to define the thin-film resistor's (103) resistance and thermal signature. Much like varying the number of perforations (104) defined within the thin-film resistor (103), varying the density of the of the perforations (104) within the thin-film resistor (103) may result in higher or lower current densities between the perforations (104) and an increase or decrease in the number of nucleation sites along the thin-film resistor (103). There exists some thermal diffusion that takes place in passivation and Ta layers of the thin-film resistor (103) as the heat passes from the thin-film resistor (103) to the fluid. Thus, while the characteristics of the thin-film resistor (103) determines the location of the nucleation sites, the nucleation sites spread out spatially once they reach the fluid interface.

As to a fifth characteristic of the thin-film resistor (103), the amount of non-perforated portions of the resistive thin film material of the thermal fluid ejection heating element (100) may also define the resistance and thermal signature of the thin-film resistor (103). As is described herein in connection with the examples of FIGS. 8 and 9, portions of the thin-film resistor (103) may be unperforated. These unperforated portions may be located along any portion of the thin-film resistor (103) and may be used to adjust the resistance of the thin-film resistor (103). Further, the portions of the thin-film resistor (103) that include the perforations (104), in contrast to the non-perorated portions, are used as the nucleation sites.

As to a sixth characteristic of the thin-film resistor (103), the shape of the perforations (104), the perforations (104) as depicted in FIG. 1 have a diamond shape. However, the shape of the perforations (104) may be any symmetrical or asymmetrical shape. For example, the shape of the perforations (104) may be hexagonal to provide for a number of additional nucleation points along the outer perimeter of the perforations (104). In another example, the perforations (104) may be circular such that nucleation of the fluid may occur anywhere along the circumference of the circular perforations (104). In one example, the perforations (104) may be defined by any polygon.

As to a seventh characteristic of the thin-film resistor (103), the material from which the thin-film resistor (103) is made plays a role in the resistance and thermal signature of the thermal fluid ejection heating element (100). In one example, the thin-film resistor (103) is made of any material with a negative temperature coefficient of resistance. Some materials exhibit a negative temperature dependence of resistance behavior. This effect is governed by an Arrhenius equation over a wide range of temperatures:

$$R = Ae^{\frac{B}{T}} \qquad \text{Eq. 1}$$

where R is resistance, A and B are constants, and T is absolute temperature (K). The constant B is related to the energies required to form and move the charge carriers responsible for electrical conduction. Thus, as the value of B increases, the material becomes insulating. Another way of expressing this is as follows:

$$R=R_0\exp^{(TCR(T-T_0))} \qquad \text{Eq. 2}$$

where TCR is the temperature coefficient of resistance. The TCR describes the relative change of a physical property that is associated with a given change in temperature. In one example, the material of the thin-film resistor (103) may be chosen to combine modest resistance with a value of B that provides good sensitivity to temperature. In some example, the thin-film resistor (103) may be characterized using the B parameter equation:

$$R = r^{\infty}e^{\frac{B}{T}} = R_0e^{\frac{-B}{T_0}}e^{\frac{B}{T}} \qquad \text{Eq. 2}$$

where $R_0$ is resistance at temperature $T_0$. Therefore, many materials that produce acceptable values of $R_0$ include materials that have been alloyed or possess variable negative temperature coefficients, which occurs when a physical property such as thermal conductivity or electrical resistance of a material lowers with increasing temperature in a defined temperature range. The negative temperature coefficient avoids excessive local heating beneath the thin-film resistor (103), which may damage portions of a fluid chamber in which the thin-film resistor (103) resides.

The example of FIG. 1 includes a number of regularly spaced and ordered, diamond-shaped perforations (104) of identical size. However, the distribution, size, and shape of the perforations (104) may be altered as described herein. The distribution, size, and shape of the perforations (104) affect the resistance of the thermal fluid ejection heating element (100), the distribution of heat provide by the thermal fluid ejection heating element (100), and the ability of the thermal fluid ejection heating element (100) to nucleate the fluid within a firing chamber.

Figure 2:
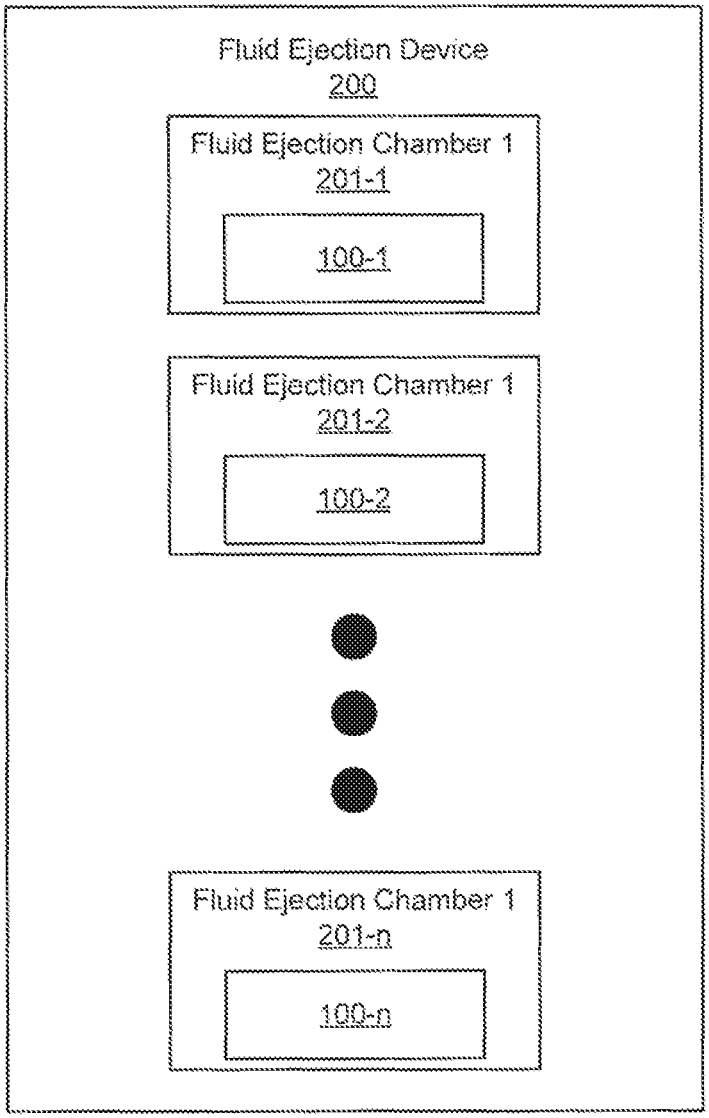
FIG. 2 is a block diagram of a fluid ejection device, according to an example of the principles described herein.

FIG. 2 is a block diagram of a fluid ejection device (200), according to an example of the principles described herein. The fluid ejection device (200) may include a number of fluid ejection chambers (201-1, 201-2, **201-*n*, collectively referred to herein as 201), and a number of thermal fluid ejection heating elements (100-1, 100-2, 100-*n*, collectively referred to herein as 100) disposed within each of the fluid ejection chambers (201). The thermal fluid ejection heating elements (100) include an at least partially perforated resistive thin film material (103) electrically coupling a first trace (101) to a second trace (102). The perforations (104) within the perforated resistive thin film material (103**) define a resistance of the resistor.

In one example, the perforated resistive thin film material (103) includes a number of diamond-shaped perforations (104). The diamond-shaped perforations (104) may form a lattice structure in the perforated resistive thin film material. Further, the at least partially perforated resistive thin film material (103) includes at least a portion of non-perforated resistive thin film material. The portion of non-perforated resistive thin film material spanning at least a width of a plurality of perforations of the at least partially perforated resistive thin film material.

In one example, at least one of the perforations (104) of the at least partially perforated resistive thin film material (103) includes different dimensions, a different shape, or combinations thereof relative to a remainder of the perforations. In this example, the thermal fluid ejection heating element (100) of FIG. 1 may include, for example, a number of perforations (104) located at the center of the thin-film resistor (103) that are relatively larger or smaller than those perforations (104) that are located on a perimeter of the thin-film resistor (103). This example may allow for a gradient in resistance, thermal signature, and nucleation numbers about the surface of the thin-film resistor (103).

In one example, each of the thin-film resistive elements (103) of the thermal fluid ejection heating element (100) disposed within each of the fluid ejection chambers (201)

may be perforated to ensure isolated failure with respect to other thin-film resistive elements within the fluid ejection device. Because the resistive sub-elements (105) of the thin-film resistor (103) fail in a cascading manner when one of the resistive sub-elements (105) fails individually resulting in an open circuit, the failure of a thin-film resistor (103) of the array of thermal fluid ejection heating elements (100) does not affect the failure of a neighboring thermal fluid ejection heating element (100) or any other thermal fluid ejection heating element (100) within the array of thermal fluid ejection heating element (100) of FIG. 2. In fact, any given thermal fluid ejection heating element (100) fails in isolation relative to any other thermal fluid ejection heating element (100).

The fluid ejection device (200) of FIG. 2, may further include a resistance gradient within at least one of the thin-film resistive elements disposed within each of the fluid ejection chambers. The resistance gradient may be defined by a position of the perforations (104), a size of each of the perforations (104), a number of the perforations (104), a density of the of the perforations (104), an amount of non-perforated portions of the resistive thin film material (104), other characteristics of the thin-film resistor (103) described herein, or combinations thereof. In one example, the resistance gradient may define a thermal signature of the thermal fluid ejection heating element (100).

Figure 3:
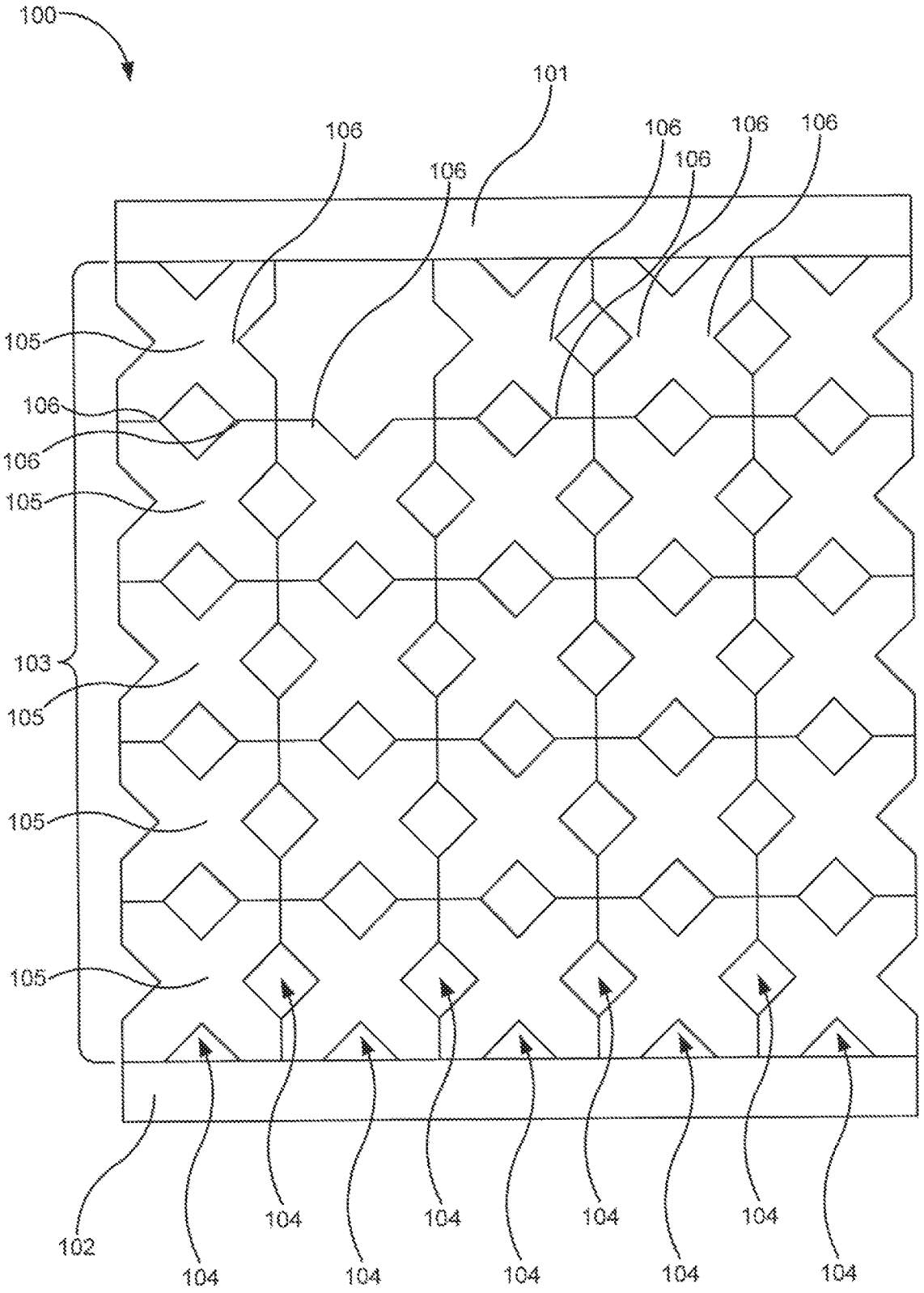
FIGS. 3 through 7 is a series of diagrams depicting a resistor including a thin film material experiencing a cascade in failure, according to an example of the principles described herein.
Figure 4:
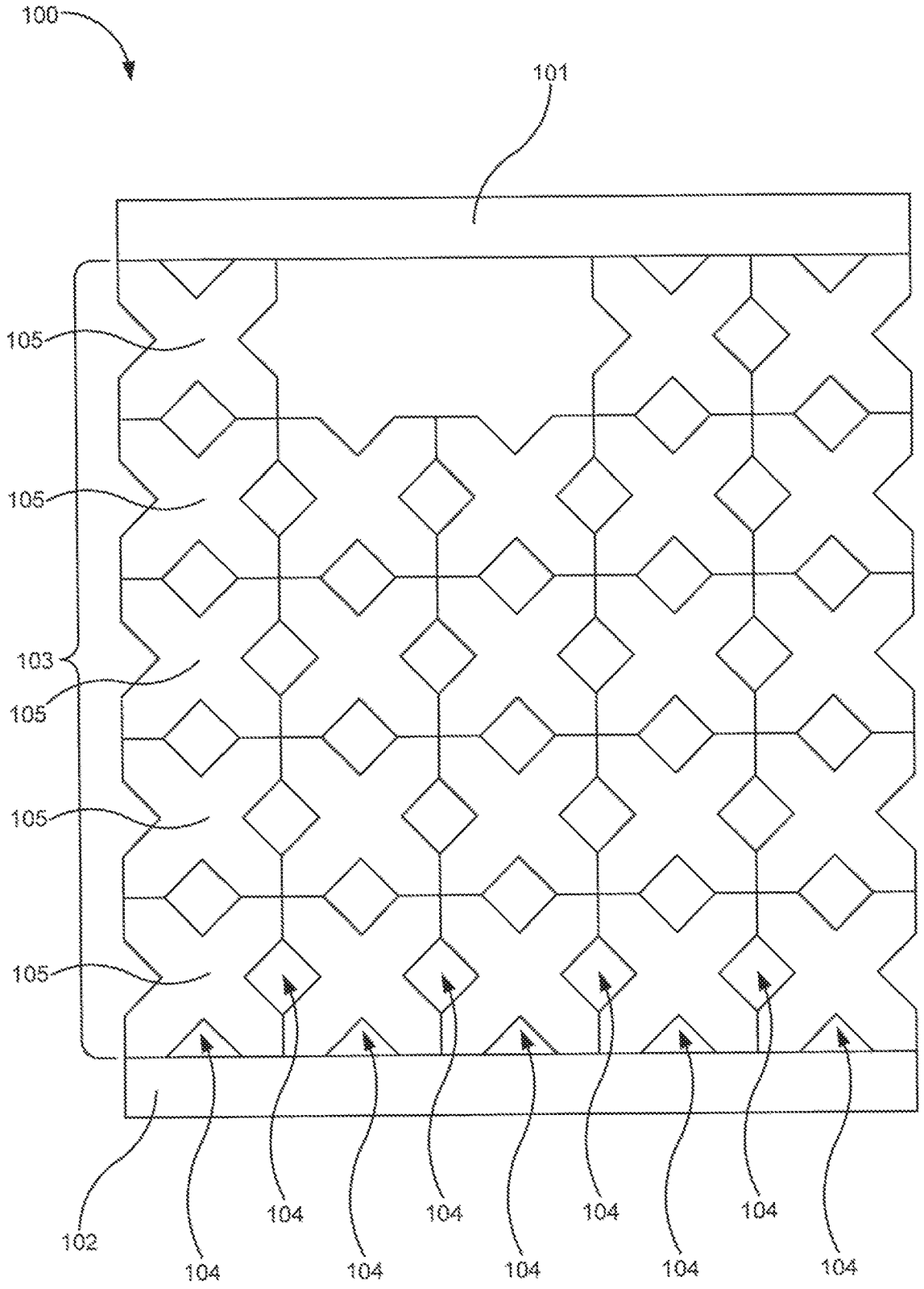
Figure 5:
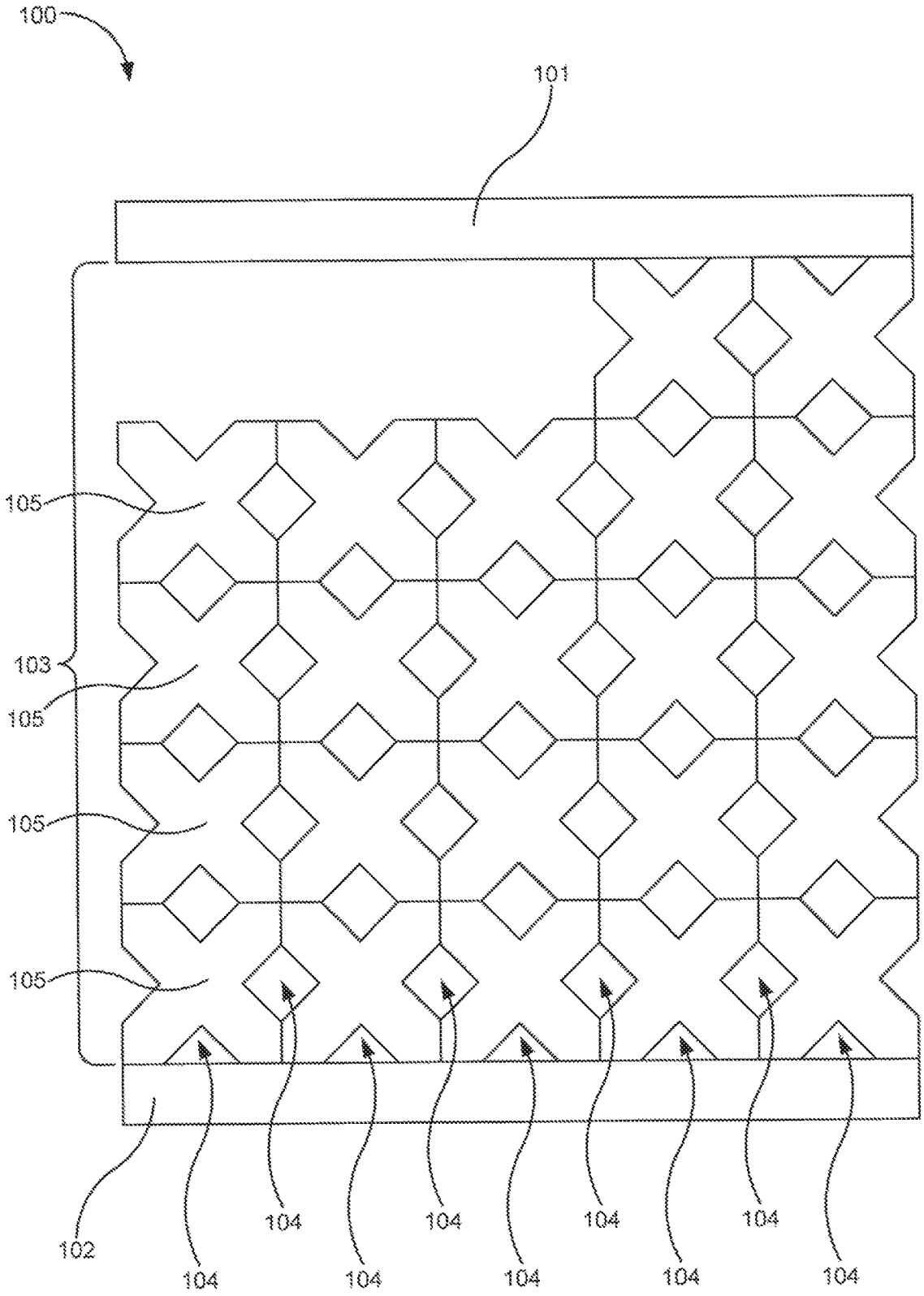

FIGS. 3 through 7 is a series of diagrams depicting a thermal fluid ejection heating element (100) including the thin-film resistor (103) experiencing a cascade in failure, according to an example of the principles described herein. In FIG. 3, a first resistive sub-element (105) has failed as indicated by its removal in comparison to a non-compromised thin-film resistor depicted in FIG. 1. The failure of this first resistive sub-element (105) may have occurred die to several reasons including, for example, impurities built into that first resistive sub-element (105) that changed its resistance, a spike in current through the first resistive sub-element (105) or some other phenomena that causes a resistive sub-element (105) to fail.

The current within and between the resistive sub-elements (105) tends to crowd around the corners (106) within and between the thin-film resistor (103). Current within geometrically non-linear resistive elements does not move uniformly everywhere within the geometrically non-linear resistive elements. Such is the case with the resistive sub-elements (105) individually and collectively within the thin-film resistor (103). These corners (106) experience higher temperatures and faster increases in temperature relative to non-corner areas. Because of this temperature discrepancy between corner (106) and non-corner areas of the resistive sub-elements (105) in the thin-film resistor (103), these corners (106) become those areas of the resistive sub-elements (105) that nucleate the fluid within the fluid ejection chambers (201). Thus, the geometries of the perforations (104) may be designed to create these nucleation sites by placing the corners (106) where the designer wishes the nucleation sites to be during operation.

Figure 6:
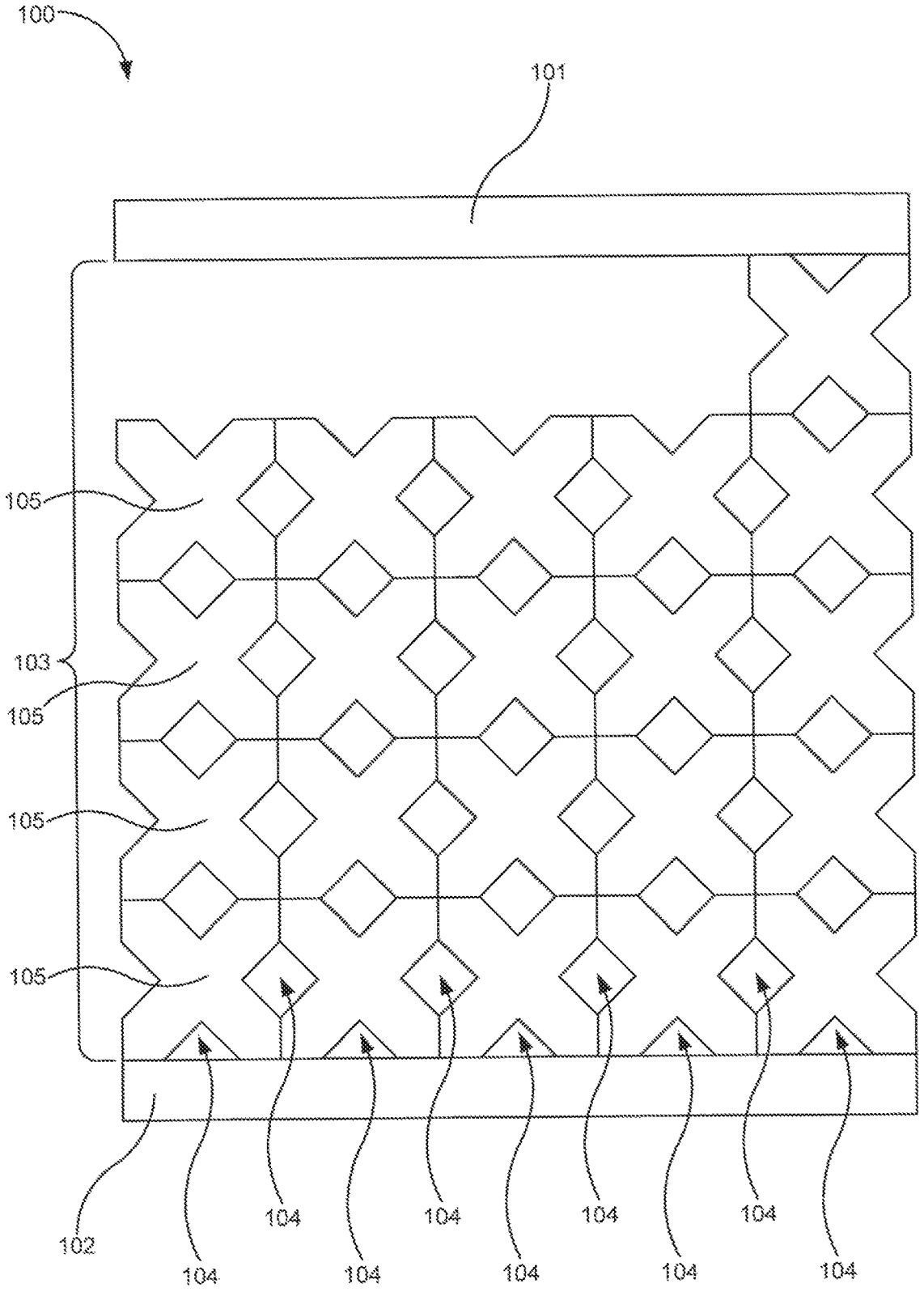
Figure 7:
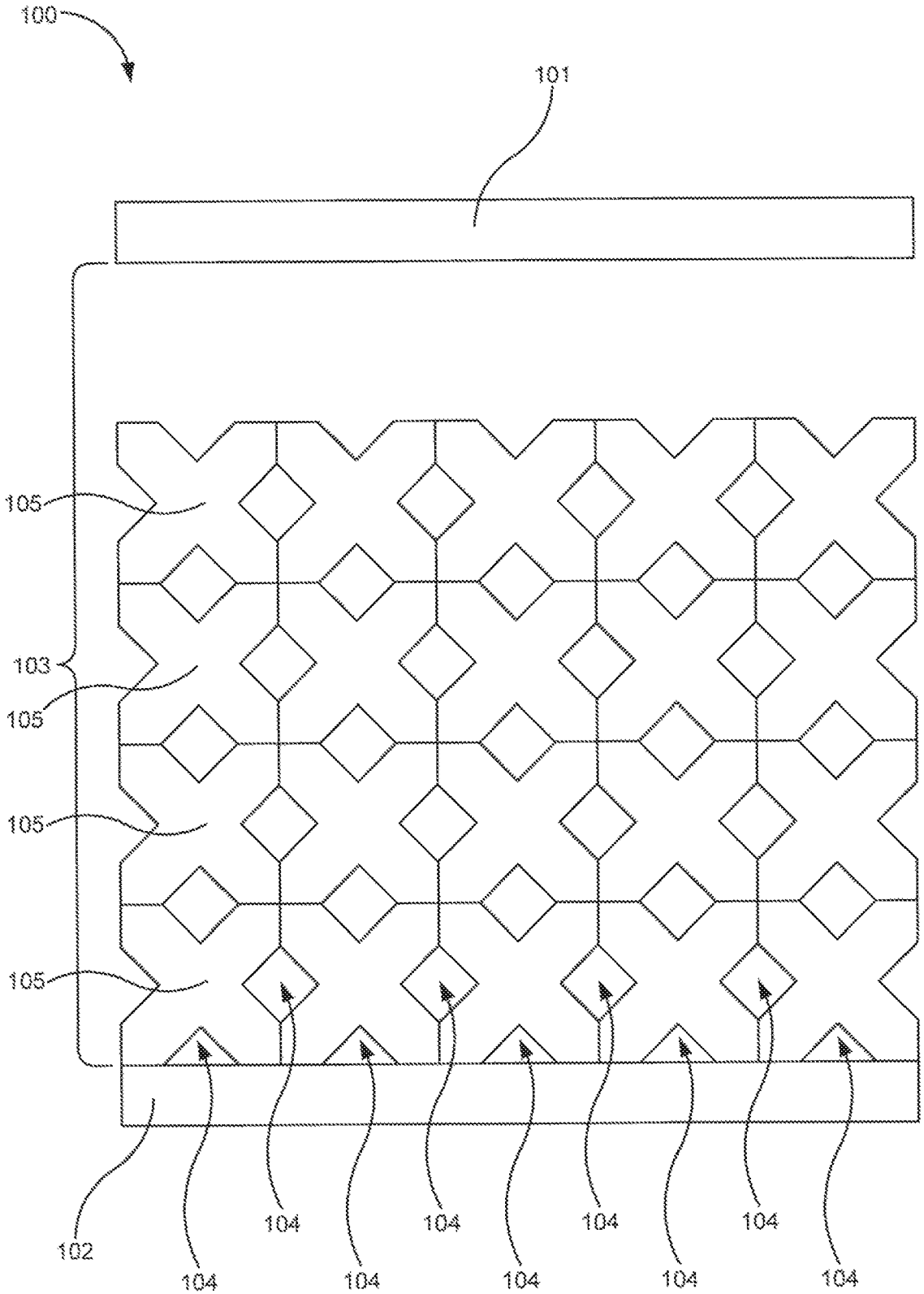

The phenomena of current crowding also occurs when at least of the resistive sub-elements (105) fail. When this occurs, the current is forced into the remaining resistive sub-elements (105) surrounding the failed resistive sub-element (105). As the current travels past the failed resistive sub-element (105) from the first conductive trace (101) to the second (102) conductive trace, the current crowds in the remaining neighboring resistive sub-element (105) and increases the current density within these remaining resistive sub-elements (105). This, in turn, increases the temperature within the remaining resistive sub-elements (105) and causes the remaining resistive sub-elements (105) to fail as demonstrated in FIGS. 4 through 7 in a cascading manner. Eventually, one remaining resistive sub-element (105) within a row of resistive sub-elements (105) may be present as depicted in FIG. 6, and that remaining resistive sub-element (105) may fail leaving the resistor in an open state as depicted in FIG. 7 where no remaining resistive sub-elements (105) are left to close the circuit. This opening of the thin-film resistor (103) happens very quickly such that the thermal fluid ejection heating element (100) is no longer usable as a fluid ejection device. In this example, a printing device in which the thermal fluid ejection heating element (100) exists may identify that the thin-film resistor (103) has been opened, and use other thin-film resistors (103) within other fluid ejection chambers (201) to take on the ejection of fluids that the open thin-film resistor (103) was instructed to eject.

Figure 8:
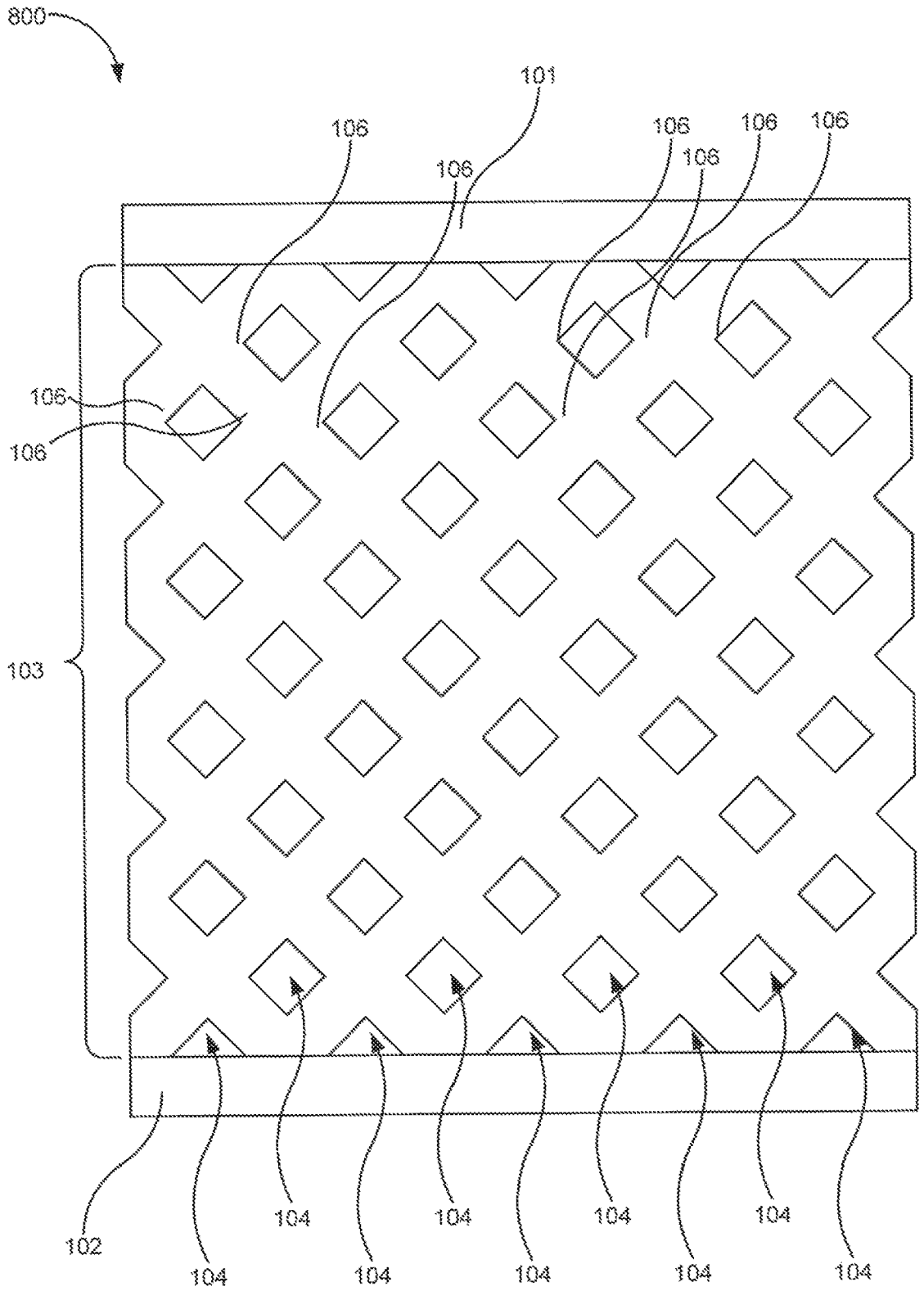
FIG. 8 is a diagram of a thermal fluid ejection heating element, according to another example of the principles described herein.

FIG. 8 is a diagram of a thermal fluid ejection heating element (800), according to another example of the principles described herein. In the example of FIG. 8, the thin-film resistor (103) may include a continuous resistive element rather than individual resistive sub-elements (105) as depicted in FIGS. 1 and 3 through 7. However, even though individual resistive sub-elements (105) are not present in the example of FIG. 8, the current within the continuous thin-film resistor (103) crowds around the corners (106) creating a higher current density around the corners (106) as described herein.

Figure 9:
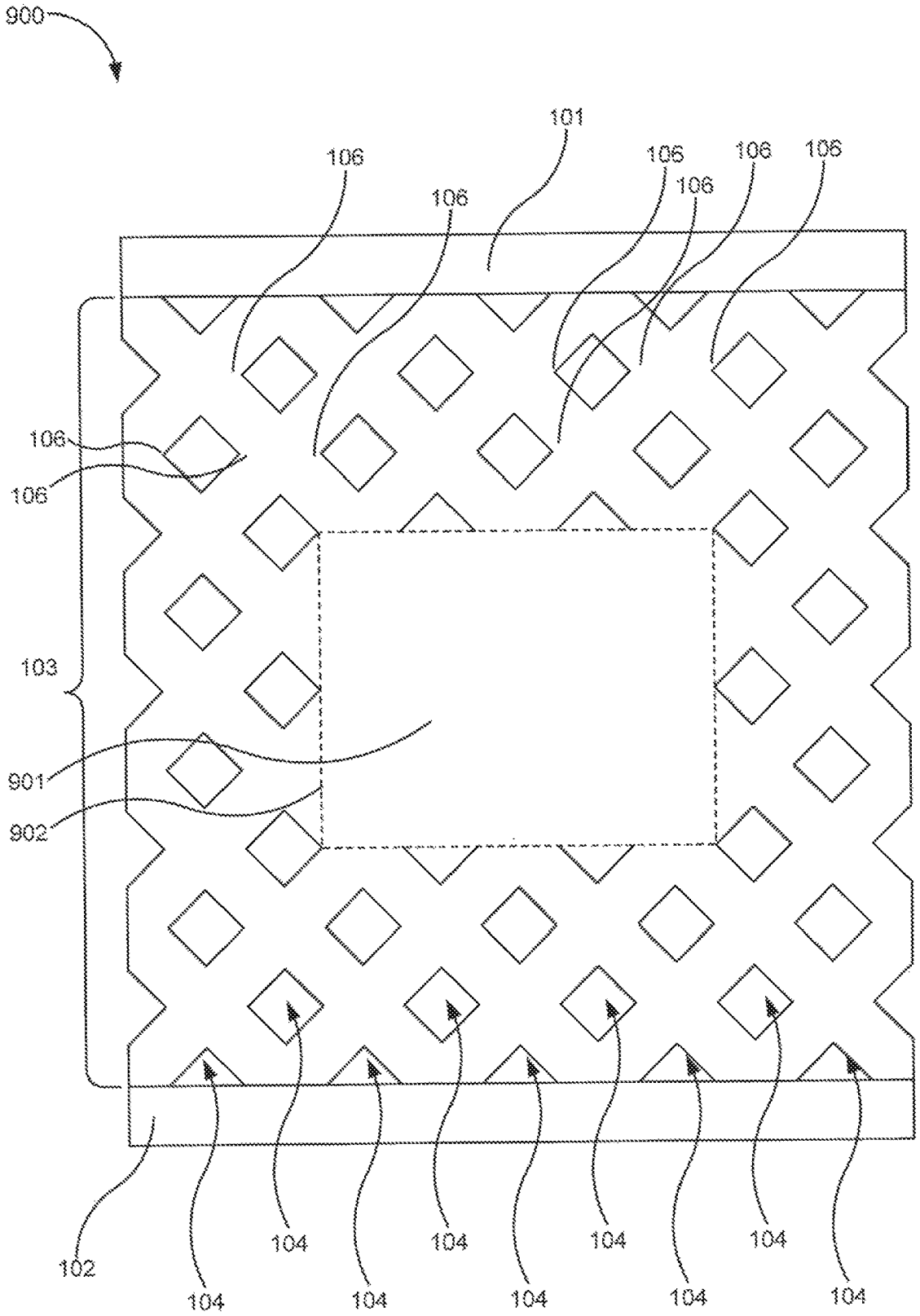
FIG. 9 is a diagram of a thermal fluid ejection heating element including a non-perforated portion, according to an example of the principles described herein.

FIG. 9 is a diagram of a thermal fluid ejection heating element (900) including a non-perforated portion (901), according to an example of the principles described herein. The non-perforated portion (901) is designated by line 902, and includes a solid portion of resistive material without perforations (104). The non-perforated portion (901) serves to create a uniform portion of resistive material while still providing a number of nucleation points using a number of perforations (104) and their respective corners (106). As to the perforated portion of the thermal fluid ejection heating element (900) of FIG. 9, although a continuous resistive element without the individual resistive sub-elements (105) as depicted in FIGS. 1 and 3 through 7 is depicted in FIG. 9, the example of FIG. 9 may include the individual resistive sub-elements (105) within the perforated portion. The perforated portion (104) of the thermal fluid ejection heating element (900) of FIG. 9 provides for the cascading failure of the thermal fluid ejection heating element (900) separating the non-perforated portion (901) from at least one of the first conductive trace (101) or second conductive trace (102) through failure of the perforations (104). Thus, in the example of FIG. 9, the thin-film resistor (103) may be used in scenarios where the user desires a continuous resistive portion in the non-perforated portion (901) and a nucleation-creating portion in the perforations (104), while still having the ability to allow the thermal fluid ejection heating element (900) to fail in an isolated manner should such a failure occur.

Figure 10:
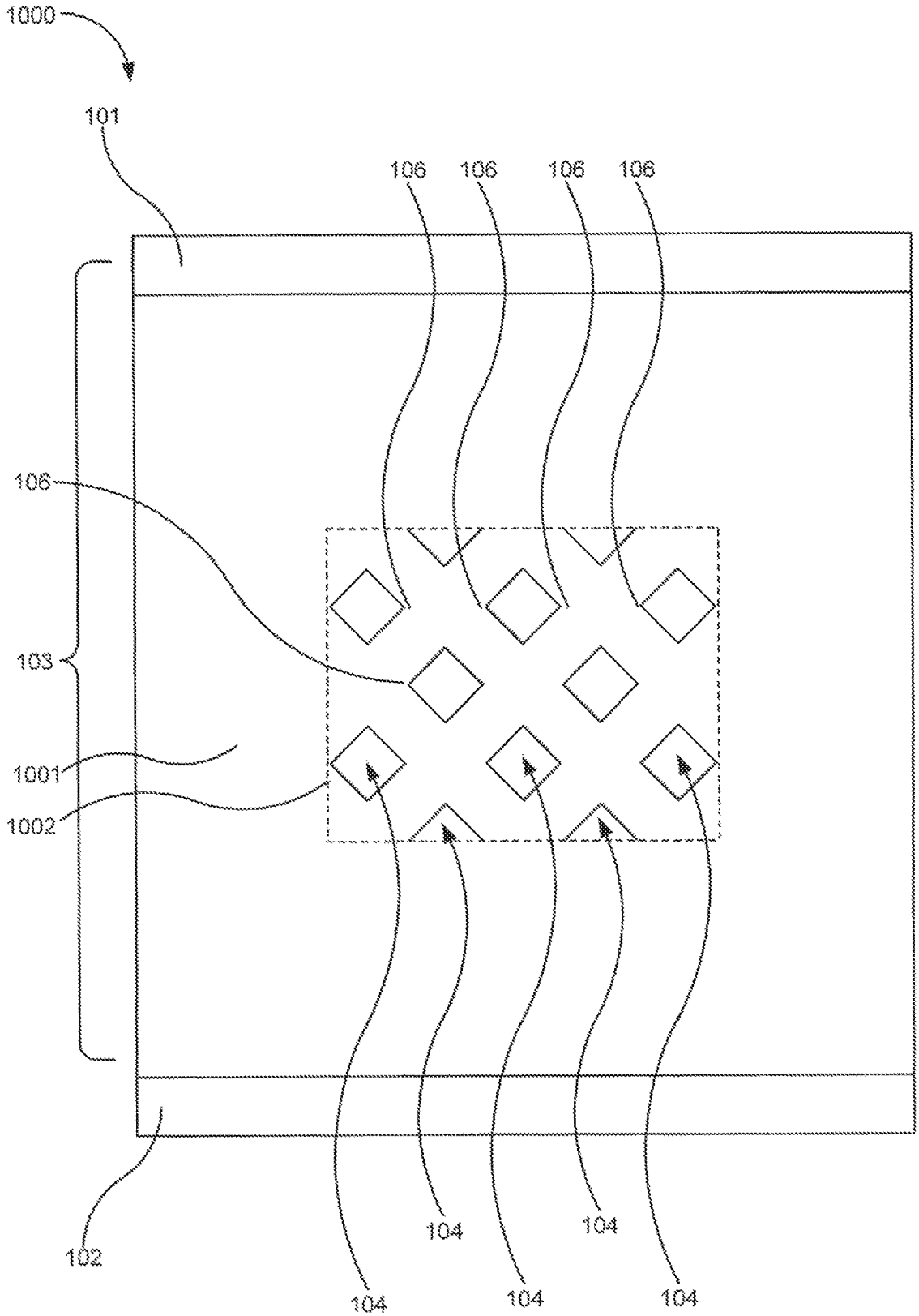
FIG. 10 is a diagram of a thermal fluid ejection heating element including a non-perforated portion, according to another example of the principles described herein.

FIG. 10 is a diagram of a thermal fluid ejection heating element (1000) including a non-perforated portion (1001), according to another example of the principles described herein. The non-perforated portion (1001) is indicated by line (1002), and includes a continuous, non-perforated portion of resistive material surrounding a portion of the resistive material including perforations (104). The non-perforated portion (1001) serves to create a uniform portion of resistive material while still providing a number of nucleation points using a number of perforations (104) and their respective corners (106) located in the center of the non-perforated portion (1001). As to the perforated portion of the thermal fluid ejection heating element (1000) of FIG. 10, although a continuous resistive element without the individual resistive sub-elements (105) as depicted in FIGS. 1 and 3 through 7 is depicted in FIG. 109, the example of FIG. 10 may include the individual resistive sub-elements (105) within the perforated portion. The perforated portion (104) of the thermal fluid ejection heating element (1000) of FIG. 10 provides for nucleation to occur within a firing chamber (201) containing the thermal fluid ejection heating element (1000) of FIG. 10 to assist in ejecting fluid from the firing chamber (1000).

Further, the cascading failure of the thermal fluid ejection heating element (1000) due to the inclusion of the perforations (104) may assist in separating the thin-film resistor (103) from at least one of the first conductive trace (101) or second conductive trace (102). In this example, a failure of the thin-film resistor (103) may occur first in an area of the thin-film resistor (103) that includes the perforations (104), and this failure may cascade onto the non-perforated portion (1001) making it easier for the non-perforated portion (1001) to fail as well and open the circuit created by the thin-film resistor (103).

Like the example of FIG. 9, the thin-film resistor (103) of FIG. 10 may be used in scenarios where the user desires a continuous resistive portion in the non-perforated portion (1001) and a nucleation-creating portion in the perforations (104), while still having the ability to allow the thermal fluid ejection heating element (1000) to fail in an isolated manner should such a failure occur.

In the examples of FIGS. 8 and 9, the at least partially perforated resistive thin film material may include at least a portion of non-perforated resistive thin film material (901, 1001) where the portion of non-perforated resistive thin film material (901, 1001) spans at least a width of a plurality of perforations (104) of the at least partially perforated resistive thin film material. Thus, in this example, the non-perforated portions (901, 1001) span at least as wide or tall as two neighboring perforations (104).

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general-purpose computer, special purpose computer, or other programmable data processing apparatus to produce a machine, such that the computer usable program code, when executed via, for example, a processor of an associated computing device or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe a thermal fluid ejection heating element may include a first conductive trace, and an at least partially perforated resistive thin film material electrically coupling the first conductive trace to a second conductive trace. The perforations within the perforated resistive thin film material defines a resistance of the thermal fluid ejection heating element.

This thermal fluid ejection heating element improves the performance and efficiency while allowing the design to be manufactured with thicker resistor material thin-films. Thicker films are more easily manufactured to specific thickness tolerances which improves the design performance. Effective heating areas can be produced that emulate single rectangular resistor solutions while enabling use of the more manufacture-able thickness thin film material. Further, resistors with small area footprints can be produced using the examples described herein to achieve high nozzle pitch densities without sacrificing X/Y geometric ratio and resistance targets which could not be otherwise achieved. These geometric ratios and resistances may enable use of specific fluid or ink chemistries. Furthermore, the lattice may enable gradations in the resistance within the perimeter definition. This can be used to tune the heat signature and adjust local current densities. Tunable resistors within a column of fluid ejection chambers and nozzles may be achieved using varying resistances to adjust parasitic influences.

The preceding description has been presented to illustrate and describe examples of the principles described. This description is not intended to be exhaustive or to limit these principles to any precise form disclosed. Many modifications and variations are possible in light of the above teaching.

What is claimed is:

1. A thermal fluid ejection heating element, comprising:
- a first conductive trace; and
- an at least partially perforated resistive thin film material electrically coupling the first conductive trace to a second conductive trace,
- wherein:
  - the at least partially perforated resistive thin film is divided into individual resistive sub-elements arranged to cascade in failure; and
  - perforations within the perforated resistive thin film material:
    - are in a symmetrical lattice pattern across the resistive thin film material; and
    - define a resistance of the thermal fluid ejection heating element.

2. The thermal fluid ejection heating element of claim 1, wherein the perforated resistive thin film material comprises a number of diamond-shaped perforations forming the lattice pattern.

3. The thermal fluid ejection heating element of claim 1, wherein the resistive thin film material is made of tantalum aluminum (TaAl).

4. The thermal fluid ejection heating element of claim 1, wherein a position of the perforations, a size of each of the perforations, a number of the perforations, a density of the of the perforations, an amount of non-perforated portions of the resistive thin film material, a shape of the perforations, or combinations thereof define a thermal signature of the thermal fluid ejection heating element.

5. The thermal fluid ejection heating element of claim 1, wherein the temperature coefficient of resistance of the perforated resistive thin film material is negative.

6. The thermal fluid ejection heating element of claim 1, comprising at least a portion of the at least partially perforated resistive thin film material comprising at least a portion of non-perforated resistive thin film material.

7. The thermal fluid ejection heating element of claim 6, wherein the portion of non-perforated resistive thin film material is surrounded by the perforations.

8. The thermal fluid ejection heating element of claim 1, wherein at least one of the perforations has a different dimension and a different shape relative to a remainder of the perforations.

9. The thermal fluid ejection heating element of claim 1, wherein the resistive thin film material is made of tungsten silicon nitride (WSiN).

10. A fluid ejection device comprising:

a number of fluid ejection chambers; and a number of thin-film resistive elements disposed within each of the fluid ejection chambers, the resistive elements comprising:

an at least partially perforated resistive thin film material electrically coupling a first trace to a second trace, wherein:

the at least partially perforated resistive thin film is divided into individual resistive sub-elements arranged to cascade in failure; and perforations within the perforated resistive thin film material:

are homogenously spaced across the resistive thin film material in evenly spaced offset rows in perforated portions of the at least partially perforated resistive thin film; and define a resistance of the thin-film resistive elements.

11. The fluid ejection device of claim 10, wherein the diamond-shaped perforations forming a lattice structure in the perforated resistive thin film material.

12. The fluid ejection device of claim 10, wherein the at least partially perforated resistive thin film material comprises at least a portion of non-perforated resistive thin film material, the portion of non-perforated resistive thin film material spanning at least a width of a plurality of perforations of the at least partially perforated resistive thin film material.

13. The fluid ejection device of claim 10, wherein at least one of the perforations of the at least partially perforated resistive thin film material a different shape relative to a remainder of the perforations.

14. The fluid ejection device of claim 10, wherein each of the thin-film resistive elements disposed within each of the fluid ejection chambers are perforated to ensure isolated failure with respect to other thin-film resistive elements within the fluid ejection device.

15. The fluid ejection device of claim 10, further comprising a resistance gradient within at least one of the thin-film resistive elements disposed within each of the fluid ejection chambers, wherein the resistance gradient is defined by a position of the perforations, a size of each of the perforations, a number of the perforations, a density of the of the perforations, an amount of non-perforated portions of the resistive thin film material, or combinations thereof, and wherein the resistance gradient defines a thermal signature of the thermal fluid ejection heating element.

16. A resistor comprising:

a thin-film resistive material electrically coupling a first trace to a second trace; and a number of perforations defined in the thin film resistive material, the perforations defining a resistance of the resistor, wherein the perforations:

define a number of resistive sub-elements in series and parallel, are homogenously spaced across the resistive thin-film resistive material in evenly spaced offset rows in perforated portions of the at least partially perforated resistive thin film, and form a resistance gradient across a height and width of the thin-film resistive material; and wherein, in response to an open circuit failure of a sub-element, the resistive sub-elements are arranged to cascade in failure along a row at an angle relative to the evenly spaced offset rows.

17. The resistor of claim 16, wherein a boundary of the resistor is defined by a polygon.

18. The resistor of claim 16, wherein a thermal signature of the resistor is defined by a position of the perforations, a size of each of the perforations, a number of the perforations, a density of the of the perforations, an amount of non-perforated portions of the thin film resistive material, or combinations thereof.

19. The resistor of claim 16, wherein the perforations are defined in an irregular pattern in the thin-film resistive material.

20. The resistor of claim 16, wherein perforations at a center of the thin-film resistive material are a different size relative to perforations on a perimeter of the thin-film resistor.

* * * * *